US011345186B1

(12) United States Patent
Franklin

(10) Patent No.: US 11,345,186 B1
(45) Date of Patent: May 31, 2022

(54) TOOL CONTAINER

(71) Applicant: Bill Franklin, Pompano Beach, FL (US)

(72) Inventor: Bill Franklin, Pompano Beach, FL (US)

( * ) Notice: Subject to any disclaimer, the term of this patent is extended or adjusted under 35 U.S.C. 154(b) by 286 days.

(21) Appl. No.: 16/798,639

(22) Filed: Feb. 24, 2020

(51) Int. Cl.
*B44D 3/14* (2006.01)
*A45F 5/02* (2006.01)
*B44D 3/12* (2006.01)

(52) U.S. Cl.
CPC ..... *B44D 3/14* (2013.01); *A45F 5/021* (2013.01); *B44D 3/123* (2013.01)

(58) Field of Classification Search
CPC ..... B44D 3/14; B44D 3/121; B44D 3/123; A45F 5/021; A45F 2200/0575; Y10S 224/904
USPC ..... 224/148.4, 661, 222
See application file for complete search history.

(56) References Cited

U.S. PATENT DOCUMENTS 2,452,400 A * 10/1948 Stevens ..... A45D 8/185 211/DIG. 1
D286,949 S * 12/1986 Hardman ..... D3/229
4,919,317 A 4/1990 Luedtke
4,953,767 A * 9/1990 Bennett ..... F41C 33/046 224/267
5,176,302 A * 1/1993 Smith ..... B44D 3/14 224/678
5,490,618 A * 2/1996 Davidson ..... B44D 3/14 224/661
5,497,921 A * 3/1996 Dancyger ..... B44D 3/14 224/907
6,866,172 B2 3/2005 Shackelford
8,505,788 B2 * 8/2013 Thibault ..... B44D 3/14 224/183
2002/0175100 A1 * 11/2002 Holland ..... B25H 3/00 224/183
2005/0156085 A1 * 7/2005 Radovan ..... A46B 17/02 248/213.2
2008/0272269 A1 * 11/2008 Moravsky ..... B44D 3/14 248/692

* cited by examiner

*Primary Examiner* — Adam J Waggenspack
(74) *Attorney, Agent, or Firm* — Sanchelima & Associates PA; Christian Sanchelima; Jesus Sanchelima

(57) ABSTRACT

A system for a tool container including a container assembly and a mounting system assembly is disclosed. The container assembly includes a container that includes a magnetic band along an interior perimeter for attaching tools thereto. The container further includes a handle for ease of transporting the container. Importantly, mounted to the container is the mounting system assembly which includes a hook attached to the handle of the container at one end. The opposite end of the hook is attached to the user, preferably, to a belt of the user. Further, the mounting system assembly includes a strap that is mounted around the leg of the user. The strap is secured with hook and loop fasteners to adjust the strap around the user tightly. The user can carry all materials with the container and keep it secured in place with the mounting system assembly.

10 Claims, 3 Drawing Sheets

TOOL CONTAINER

BACKGROUND OF THE INVENTION

1. Field of the Invention

The present invention relates to a tool container and, more particularly, to a tool container that can hold the tools of a worker during usage and further can be attached to the user's legs and belt for added safety and security.

2. Description of the Related Art

Several designs for tool containers have been designed in the past. None of them, however, include a paint can, bucket or container comprising a magnetic band for holding a paint brush, a paint roller or other tools to the side of the can, as well as a mounting system for holding the paint can to a painters belt and leg comprising a wire hook apparatus which attaches to the can handle and then hooks into or around the painters belt, and a flexible hook and loop strap which connects to the bottom of the can and can be secured around the painters leg at the thigh.

Applicant believes that a related reference corresponds to U.S. Pat. No. 6,866,172 for a mounting system for attaching a paint bucket to a painter's belt. Applicant believes that another related reference corresponds to U.S. Pat. No. 4,919,317 for a hook attached to a belt for supporting a paint bucket handle. None of these references, however, teach of a container that includes a magnetic band for holding and keeping tools readily available while the user works.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a tool container that allows a user to store and transport tools.

It is another object of this invention to provide a tool container that includes a magnetic band to keep tools readily available for the user to grab during the completion of work tasks.

It is still another object of the present invention to provide a tool container that increases the safety of the user and those in the vicinity by allowing the user to secure the tool container to themselves.

It is also another object of the present invention to provide a tool container that is lightweight.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
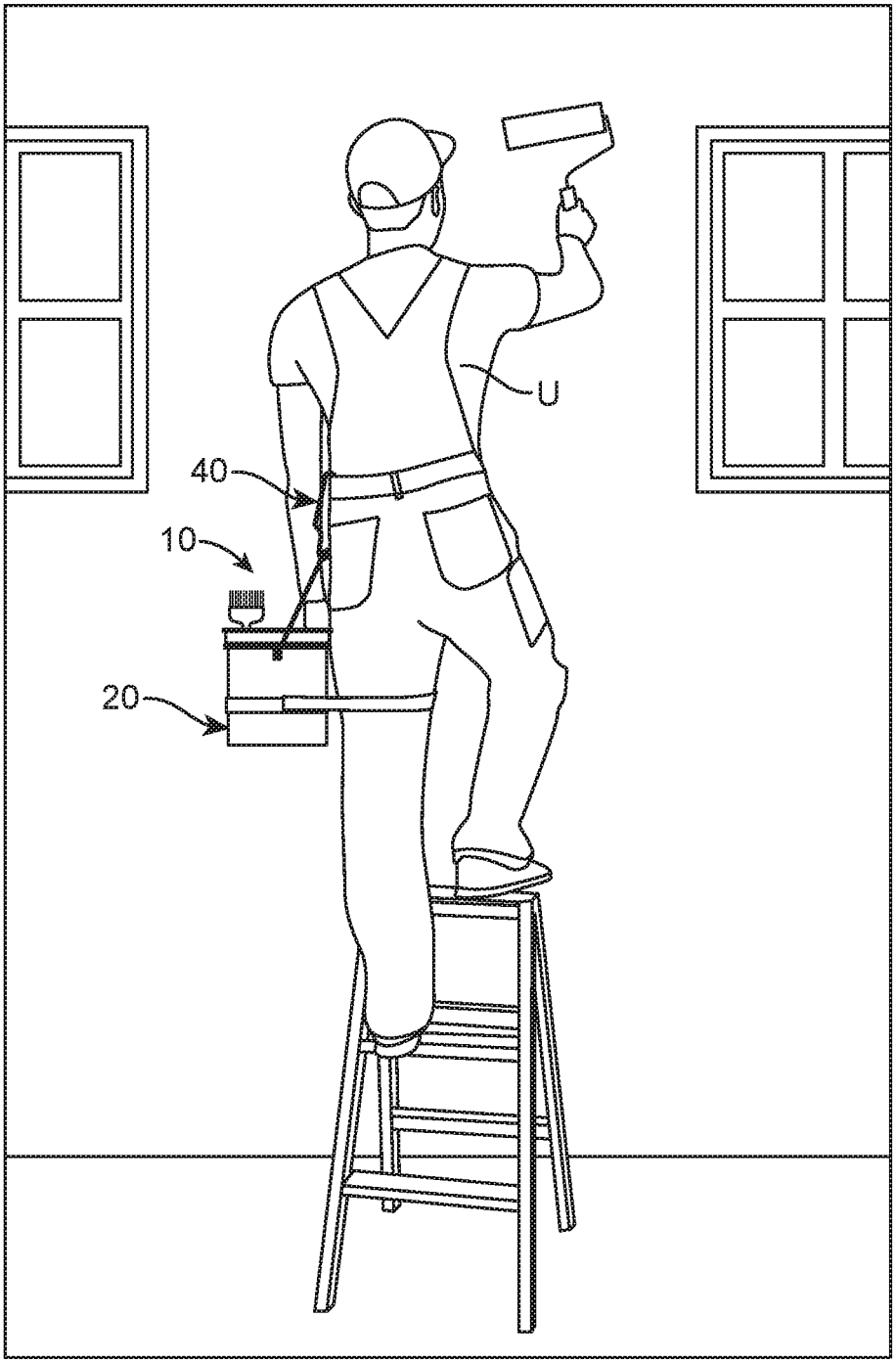
FIG. 1 represents an operational view of the tool container 10 attached to a user U that is painting a building.
Figure 2:
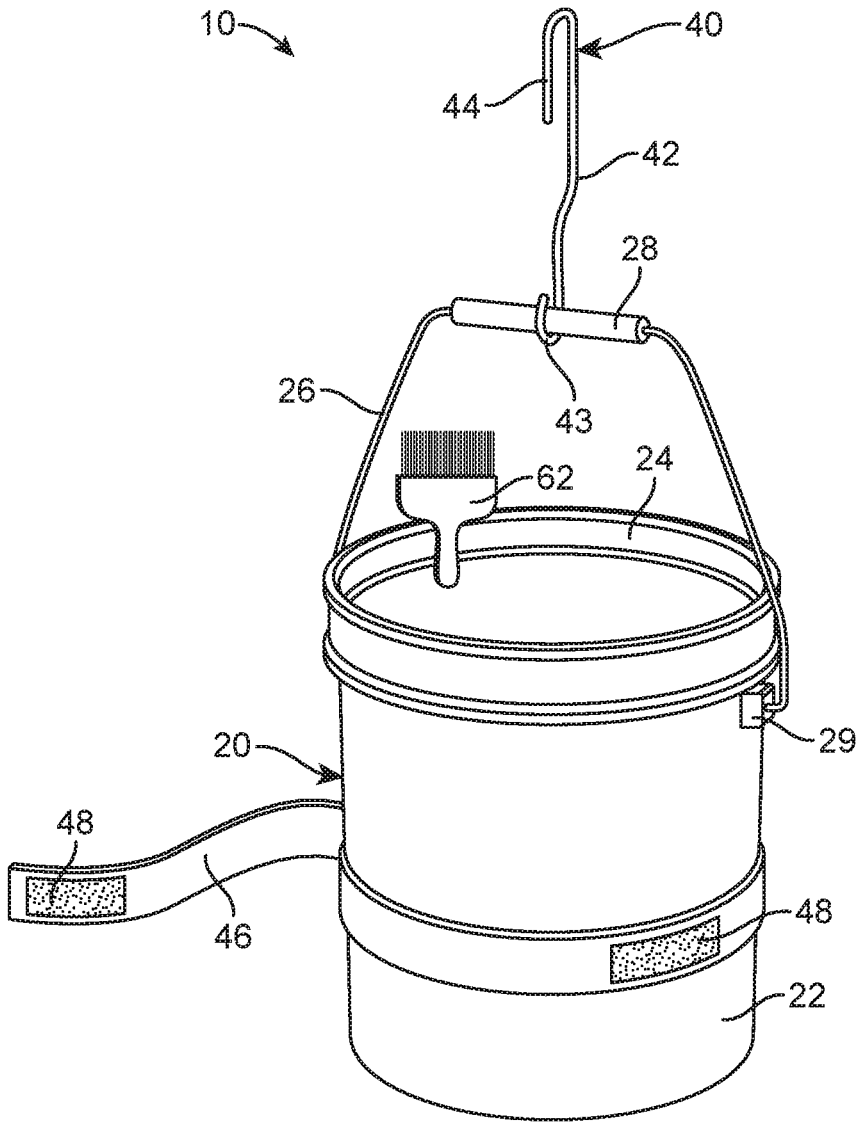
FIG. 2 shows an isometric view of the tool container 10.
Figure 3:
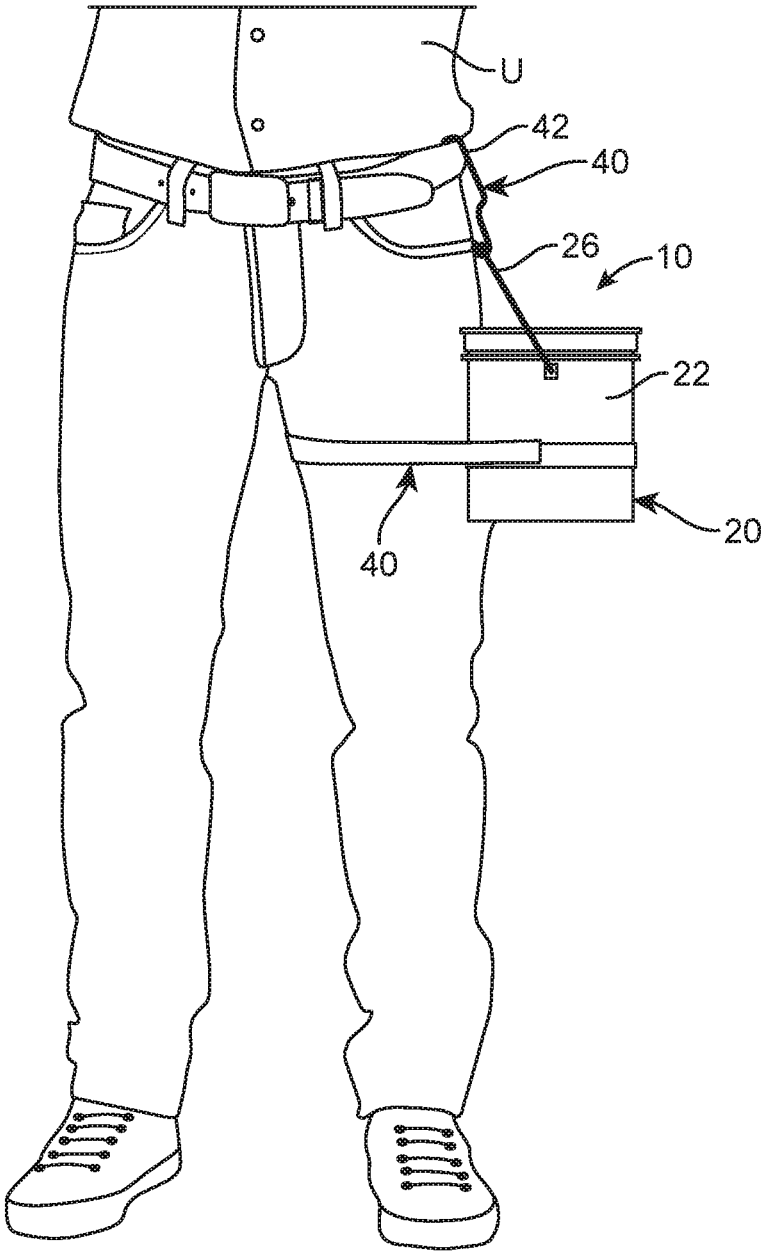
FIG. 3 illustrates a front operational view of tool container 10 attached to a user U.

Referring now to the drawings, where the present invention is generally referred to with numeral 10, it can be observed that it, a tool container 10, basically includes a container assembly 20 and a mounting system assembly 40.

It may be necessary to carry tools to complete certain jobs. Such tools may be a paint brush, a scrapper, a hammer or other similar instruments. In order for a user U to be efficient and effective, they must have all equipment readily available or lose time looking for the appropriate tool necessary to complete the task. As such, tool container 10 assists with these needs by providing a device that can be used to hold, store and transport tools 62 during usage as the user U completes a task or job. This accelerates the speed at which user U can complete tasks as there is less time lost due to the organization and availability of tools that tool container 10 provides. User U may avoid wasteful situations with the present invention. Such as losing time looking for appropriate equipment and user U may further be able to carry all needed equipment at once which reduces the need to travel back and forth to locate the equipment needed. This also helps to increase the work speed of user U as there are less distractions that can occur since the wasteful situations are reduced.

Container assembly 20 may include a container 22 that may be used to hold, store and transport tools 62. Container 22 may preferably be cylindrical in shape. However, it should be understood that other predetermined shapes may be suitable for container 22. Container 22 may preferably be lightweight. It may be suitable for container 22 to be made of plastic, stainless steel, aluminum, rubber, metal or other suitable materials. Container 22 may include a closed bottom end and an entirely open top end. Container 22 may be capable of holding, transporting and storing tools 62 within. It may also be suitable to house liquids such as paint within container 22. In one embodiment, container 22 may be a paint can. Container 22 may also include lips. One lip may be located about the perimeter of the opening of container 22. Another lip may be defined below the first lip a predetermined distance. That second lip may extend about the perimeter of container 22 and facilitate the grabbing of container 22.

Container 22 may further include a magnetic band 24. Magnetic band 24 may extend about an inner circumference of container 22 along a top portion of container 22. Magnetic band 24 may be magnetic to allow holding of tools 62 which are magnetically attracted to magnetic band 24. This means that magnetic band 24 may be capable of securing tools 62 which are made of iron, nickel, cobalt, gadolinium, dysprosium, or other ferromagnetic metals, for example. Other suitable materials with magnetism may be mounted to magnetic band 24 as well. User U may simply attach one of tools 62 to magnetic band 24 and retrieve it later as needed since it becomes readily available once mounted on magnetic band 24.

Container assembly 20 may further include a handle 26, a handle grip 28 and an attaching portion 29. Handle 26 may facilitate the carrying and transporting of container 22 and everything within container 22. Handle 26 may further be used to attach the mounting system assembly 40 thereto. Attaching portion 29 may be mounted to an outside of container 22 and protrude outwardly away from container 22. Preferably, attaching portion 29 may be mounted to a top portion of container 22. Attaching portion 29 may be square shaped in the immediate embodiment, however, it should be understood that attaching portion 29 may suitably be virtually any other shape. The distal ends of handle 26 may be mounted to attaching portion 29. Handle 26 may swivel about attaching portion 29. In one embodiment, handle 26 may be trapezoidal in shape. Handle 26 may have slanted sides and a flat top portion connecting the slanted sides. In an alternate embodiment, it may be suitable for handle 26 to be semicircular in shape. However, it should be understood that handle 26 may be of any predetermined shape. Handle 26 may be made of metal, wire, plastic or other suitable materials. Preferably, handle 26 may be thin and rounded. In one embodiment, attached around the top portion of handle 26 may be handle grip 28. Handle grip 28 may be optional. Handle grip 28 may provide comfort to user U using handle 26 while carrying container 22. Handle grip 28 may further provide a grip for mounting system assembly 40 to remain secured to handle 26. It should be understood that handle grip 28 may cover a predetermined amount of handle 26. Handle grip 28 may be made of suitable materials such as rubber, plastic, silicone, or the like. Handle grip 28 may be a tubing that is mounted around handle 26.

Mounting system assembly 40 may help to secure container 22 to user U. Mounting system assembly 40 may include a hook apparatus 42. Hook apparatus 42 may also be referred to as a wire hook apparatus or hook, as well. Hook apparatus 42 may be mounted to handle 26 at one end and to user U at an opposite end. Hook apparatus 42 may also be used to attach the present invention to an anchor point, for example, on a wall, when not in use. Hook apparatus 42 may be perpendicular to handle 26 when stored or not in use. It may also be suitable for hook apparatus 42 to be mounted to handle grip 28. Hook apparatus 42 may preferably be mounted to the belt of user U. When hook apparatus 42 is mounted to user U an acute angle may be created by hook apparatus 42. It should also be understood that hook apparatus 42 may also cause handle 26 to make contact with user U when hook apparatus 42 is mounted to user U. Hook apparatus 42 may be preferably be made of metal or wire like material such as aluminum or stainless steel. Hook apparatus 42 may be removable from the present invention. Hook apparatus 42 may have an irregular shape with two curved distal ends.

More specifically, hook apparatus 42 may include hooks at distal ends thereof. The hooks may be further defined as a first hook 43 and a second hook 44. First hook 43 may be the portion of hook apparatus 42 that attaches to handle 26 or handle grip 28. Second hook 44 may be the portion of hook apparatus 42 that attaches to user U, preferably at the belt of user U. It should be understood that first hook 43 may be smaller than second hook 44. Second hook 44 may have a length greater than that of first hook 43. First hook 43 may curve upwardly, while second hook 44 may curve downwardly 44. First hook 43 and second hook 44 may curve towards each other, with the curved portion of each extending away from one another.

To further secure container 22 to user U, mounting system assembly 40 may include a strap 46 with hook and loop fasteners 48. Strap 46 may be mounted around the perimeter of container 22. Strap 46 may be mounted to user U and container 22 when in use. Strap 46 may be mounted only around container 22 when not in use. Preferably, strap 46 may be mounted to a lower portion of container 22. Strap 46 may be flexible to allow for securing around both container 22 and users, which come in all shapes and sizes. Strap 46 may have a predetermined length to allow for securing around users' body regardless of shape and size. Strap 46 may preferably be rectangular in shape. Strap 46 may be made of cotton, wool, linen, canvas, nylon, rubber, silicone, plastic or other similar and suitable materials. At predetermined locations on strap 46 may be hook and loop fasteners 48. Hook and loop fasteners 48 allow to quickly secure, adjust, tighten, release or loosen strap 46 to user U. It is to be understood that it may be suitable for other fasteners to be used instead of hook and loop fasteners 48. Other fasteners may be buttons, snap buttons, screws, adhesives, pins, hooks and other fasteners as known in the art.

User U may use the present invention to hold their materials readily available while they work. User U may attach container 22 to themselves with mounting system assembly 40. User U may climb or move about while working and maintain all of their necessary equipment on hand and ready for usage. This helps the user be more efficient as there is no need to look for any of their necessary equipment. Additionally, user U has the ability to use both hands freely for any work instead of using one hand to carry or hold any equipment. This helps to increase the safety of user U as well.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a tool container, comprising:

a. a container assembly including a container, said container including a magnetic band extending along an interior perimeter of said container, said container including a handle, said magnetic band having tools mounted thereon; and b. a mounting system assembly including a hook apparatus, said hook apparatus mounted to said handle at one end and said hook apparatus having an attachment mechanism for mounting to a user on an opposite end, said mounting system assembly further including a strap, said strap having a first portion mounted about a perimeter of said container, said strap having a second portion for attachment around a leg of said user to further secure said container to said user.

2. The system of claim 1, wherein said strap includes hook and loop fasteners to further secure, adjust or tighten said strap to said user or said container.

3. The system of claim 1, wherein said handle includes a handle grip extending around a partial portion of said handle.

4. The system of claim 1, wherein said container includes an attaching portion for said handle to be mounted swivelably thereto.

5. The system of claim 1, wherein said hook apparatus includes a first hook and a second hook, said first hook attaches to said handle, said second hook attaches to a belt of the user.

6. The system of claim 5, wherein said first and second hook curve towards each other.

7. The system of claim 1, wherein said container is a paint can.

8. The system of claim 1, wherein said container can hold liquids or paint.

9. The system of claim 1, wherein said strap is flexible, said strap being rectangular and elongated.

10. A system for a tool container, comprising:

a. a container assembly including a container, said container including a magnetic band extending along an interior perimeter of said container, said magnetic band being located at an upper portion of said container, said container including a handle, said container assembly further including a handle grip extending about said handle, said magnetic band having tools mounted thereon, said tools being partially visible while mounted to said magnetic container, said tools being magnetic, said handle mounted to an attaching portion, said attaching portion mounted to said container, said handle swiveling about said attaching portion; and b. a mounting system assembly including a hook apparatus, said hook apparatus including a first hook and a second hook, said first hook mounted to said handle grip, said second hook mounted to a belt for wearing by a user, said first and second hook each having an open space that faces one another, said mounting system assembly further including a strap, said strap having a first portion mounted about a perimeter of said container at a lower portion of said container, said strap having a second portion for attachment around a leg of said user, said straps including hook and loop fasteners to secure and adjust said strap mounted to said user, said strap being flexible, one of said hook and loop fasteners being on an inner surface of said strap and another corresponding of said hook and loop fasteners being on an outer surface of said strap.

* * * * *